US008086156B2

(12) United States Patent
Tao et al.

(10) Patent No.: US 8,086,156 B2
(45) Date of Patent: Dec. 27, 2011

(54) BELT DEVICE AND IMAGE FORMING APPARATUS

(75) Inventors: Satoru Tao, Ibaraki (JP); Makoto Nakura, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 426 days.

(21) Appl. No.: 12/199,234

(22) Filed: Aug. 27, 2008

(65) Prior Publication Data

US 2009/0060576 A1 Mar. 5, 2009

(30) Foreign Application Priority Data

Aug. 31, 2007 (JP) ..... 2007-225307

(51) Int. Cl.
*G03G 15/01* (2006.01)

(52) U.S. Cl. ... 399/302; 198/806; 198/807; 198/810.01; 198/810.03; 474/102; 474/106

(58) Field of Classification Search ..... 399/302; 198/806, 807, 810.01, 810.03; 474/102, 474/106

See application file for complete search history.

(56) References Cited

U.S. PATENT DOCUMENTS 4,959,040 A * 9/1990 Gardner et al. ..... 474/103
5,554,262 A * 9/1996 Turner ..... 162/198
5,784,676 A * 7/1998 Iseki et al. ..... 399/301
5,819,140 A * 10/1998 Iseki et al. ..... 399/165

(Continued)

FOREIGN PATENT DOCUMENTS

JP 10109776 A * 4/1998

(Continued)

OTHER PUBLICATIONS

English machine translation of Japanese reference Hokari (JP 10-109776 A).*

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

An endless belt member is suspended in a tensioned manner by a plurality of roller members including a drive roller and a drive motor drives the drive roller member so as to move the belt member in a predetermined direction of travel. A detecting unit detects an amount of displacement of the belt member in a widthwise direction of the belt member, and a correction unit that corrects displacement of the belt member in the widthwise direction. The correction unit corrects the displacement of the belt member in a widthwise direction based on data sampled by the detecting unit every time a drive signal is input to the drive motor a prescribed number of times.

10 Claims, 5 Drawing Sheets

U.S. PATENT DOCUMENTS

| | | | | |
|---|---|---|---|---|
| 5,896,158 | A * | 4/1999 | Brenner et al. | 347/116 |
| 5,964,339 | A * | 10/1999 | Matsuura et al. | 198/810.03 |
| 6,115,572 | A * | 9/2000 | Edwards et al. | 399/162 |
| 7,668,491 | B2 * | 2/2010 | Furuya et al. | 399/302 |
| 7,905,346 | B2 * | 3/2011 | Enomoto | 198/807 |
| 7,920,814 | B2 * | 4/2011 | Atwood et al. | 399/302 |
| 2003/0219280 | A1 * | 11/2003 | Lee | 399/167 |
| 2006/0289280 | A1 * | 12/2006 | Furuya et al. | 198/806 |
| 2007/0144871 | A1 | 6/2007 | Tao et al. | |
| 2008/0019736 | A1 | 1/2008 | Ryo et al. | |
| 2008/0056778 | A1 | 3/2008 | Tao et al. | |
| 2008/0240802 | A1 * | 10/2008 | Nakura | 399/313 |
| 2009/0060605 | A1 * | 3/2009 | Ohkushi et al. | 399/363 |
| 2009/0180805 | A1 * | 7/2009 | Nakura et al. | 399/165 |
| 2010/0189475 | A1 * | 7/2010 | Atwood et al. | 399/302 |
| 2010/0329750 | A1 * | 12/2010 | Yonemoto | 399/301 |
| 2011/0123237 | A1 * | 5/2011 | Kudo et al. | 399/313 |
| 2011/0135324 | A1 * | 6/2011 | Peng et al. | 399/16 |
| 2011/0200343 | A1 * | 8/2011 | Matsumoto et al. | 399/31 |
| 2011/0206392 | A1 * | 8/2011 | Hiratsuka et al. | 399/31 |

FOREIGN PATENT DOCUMENTS

| | | | |
|---|---|---|---|
| JP | 2000233843 | A * | 8/2000 |
| JP | 2002-287527 | | 10/2002 |
| JP | 3473148 | | 9/2003 |
| JP | 2006-343629 | | 12/2006 |

OTHER PUBLICATIONS

English machine translation of Japanese reference Kobayashi et al. (JP 2000-233843 A).*

U.S. Appl. No. 12/076,813, filed Mar. 24, 2008, Unknown.

U.S. Appl. No. 12/125,519, filed May 22, 2008, Toshiyuki Andoh et al.

U.S. Appl. No. 12/104,127, filed Apr. 16, 2008, Satoru Tao et al.

* cited by examiner

BELT DEVICE AND IMAGE FORMING APPARATUS

CROSS-REFERENCE TO RELATED APPLICATIONS

The present application claims priority to and incorporates by reference the entire contents of Japanese priority document 2007-225307 filed in Japan on Aug. 31, 2007.

BACKGROUND OF THE INVENTION

1. Field of the Invention

The present invention relates a belt device for use in an image forming apparatus.

2. Description of the Related Art

Tandem color image forming apparatuses, such as copiers and printers, including an intermediate transfer belt (belt device) are well-known in the art. Such image forming apparatuses have been disclosed in, for example, Japanese Patent Application Laid-open No. 2006-343629 and Japanese Patent No. 3473148.

In a typical image forming apparatus, four photosensitive drums (image carriers) are provided side by side facing an intermediate transfer belt (belt member). Single-color toner images for black, yellow, magenta, and cyan are respectively formed on each of the four photosensitive drums. Those single-color toner images are then transferred so as to be overlaid on top of each other on the intermediate transfer belt to form a color toner image on the intermediate transfer belt. The color toner image supported on the intermediate transfer belt is then transferred to and fixed on a recording medium, such as a paper, as a color image.

Technology where displacement of an intermediate transfer belt in a widthwise direction is detected and the displacement in a widthwise direction is corrected based on results of the detection is well-known. The object of such technology is to suppress falling of the image quality due to meandering of the intermediate transfer belt and to prevent the intermediate transfer belt from becoming damaged due to being substantially displaced in a widthwise direction and coming into contact with other members.

Various method are available for correcting displacement of the intermediate transfer belt in a widthwise direction. In one known method (hereinafter, "steering method"), an angle of inclination of the intermediate transfer belt from a reference surface is adjusted by adjusting an inclination of a roller that supports the intermediate transfer belt. Such a method has been disclosed in, for example, Japanese Patent Application Laid-open No. 2006-343629 and Japanese Patent No. 3473148. In another know method (hereinafter, "belt guide method"), the edges of the intermediate transfer belt are guide so as to suppress displacement of the intermediate transfer belt. The steering method is advantageous compared to the belt guide method in that the load placed on the intermediate transfer belt is much smaller which increases the durability of the intermediate transfer belt.

Specifically, in Japanese Patent Application Laid-open No. 2006-343629, an extent of displacement of a contact that abuts with an end in a width direction of the intermediate transfer belt (endless belt) and reciprocates in accordance with displacement of the intermediate transfer belt is detected by a displacement sensor. Displacement (meandering) of the intermediate transfer belt is then corrected by a meandering correction roller based on the detection results of the displacement sensor.

On the other hand, technology also exists for correcting meandering by periodically detecting meandering of a belt member such as an intermediate transfer belt or a transport belt. Such technology is disclosed in Japanese Patent No. 3473148. This technology accurately detects meandering of the belt member while excluding meandering characteristics peculiar to the rollers and meandering characteristics peculiar to the belt. This is achieved by matching the timing of detecting meandering of the belt member with a rotational period of the roller member (roller) and belt period.

In order to accurately detect an amount of displacement in a widthwise direction of the belt member using a detecting unit without influencing cutting tolerance (a wave-like cutting mark occurring during cutting processing) for both ends of the belt member in a widthwise direction, the amount of displacement in a widthwise direction of the belt member is sampled periodically (at fixed time intervals) by a detecting unit. Meandering correction for the belt member is then performed based on the sampled data. However, when the speed of travel of the belt member accelerates or decelerates, the sampled data is not for equal intervals with respect to the direction of travel of the belt member. Therefore, the sampled data is affected by the cutting tolerance of the belt member so that it is no longer possible to accurately detect the amount of displacement in the widthwise direction of the belt member.

Linear process speed is fast and higher durability is required in high-speed image forming apparatuses. In particular, it is common with high-speed apparatus where the belt member travels at high-speed for acceleration (slow starting) to be carried out when the belt member starts to travel and for deceleration (slow down) to be carried out when traveling of the belt member ends. This is in order to suppress abrupt loads from being applied to configuration components constituting the belt device such as, for example, motors and gears. It is therefore not possible to ignore the problems explained above. Such problems are not limited to belt devices using an intermediate transfer belt as a belt member, but are common to even other belt devices that detect and correct displacement of belt members such as belt devices using a transfer belt as a belt member or belt devices using a photosensitive belt as a belt member.

SUMMARY OF THE INVENTION

It is an object of the present invention to at least partially solve the problems in the conventional technology.

According to an aspect of the present invention, there is provided a belt device for use in an image forming apparatus. The belt device includes an endless belt member that is suspended in a tensioned manner by a plurality of roller members including a drive roller; a drive motor that drives the drive roller member so as to move the belt member in a predetermined direction of travel; a detecting unit that detects an amount of displacement of the belt member in a widthwise direction of the belt member; and a correction unit that corrects displacement of the belt member in the widthwise direction based on data sampled by the detecting unit every time a drive signal is input to the drive motor a prescribed number of times.

According to another aspect of the present invention, there is provided a belt device for use in an image forming apparatus. The belt device includes an endless belt member that is suspended in a tensioned manner by a plurality of roller members including a detection target roller; a detecting unit that detects an amount of displacement of the belt member in a widthwise direction of the belt member; a correction unit that corrects displacement of the belt member in the widthwise direction; and a rotation detecting unit that detects an amount of rotation of the detection target roller. The correction unit corrects displacement of the belt member in the widthwise direction based on data sampled by the detecting unit every time a number of signals output from the rotation detecting unit reaches a prescribed number.

According to still another aspect of the present invention, there is provided a belt device for use in an image forming apparatus. The belt device includes an endless belt member capable of moving in a predetermined direction of travel; a detecting unit that detects an amount of displacement of the belt member in a widthwise direction of the belt member; and a correction unit that corrects displacement of the belt member in the widthwise direction based on data sampled by the detecting unit every time the belt member travels a prescribed distance.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
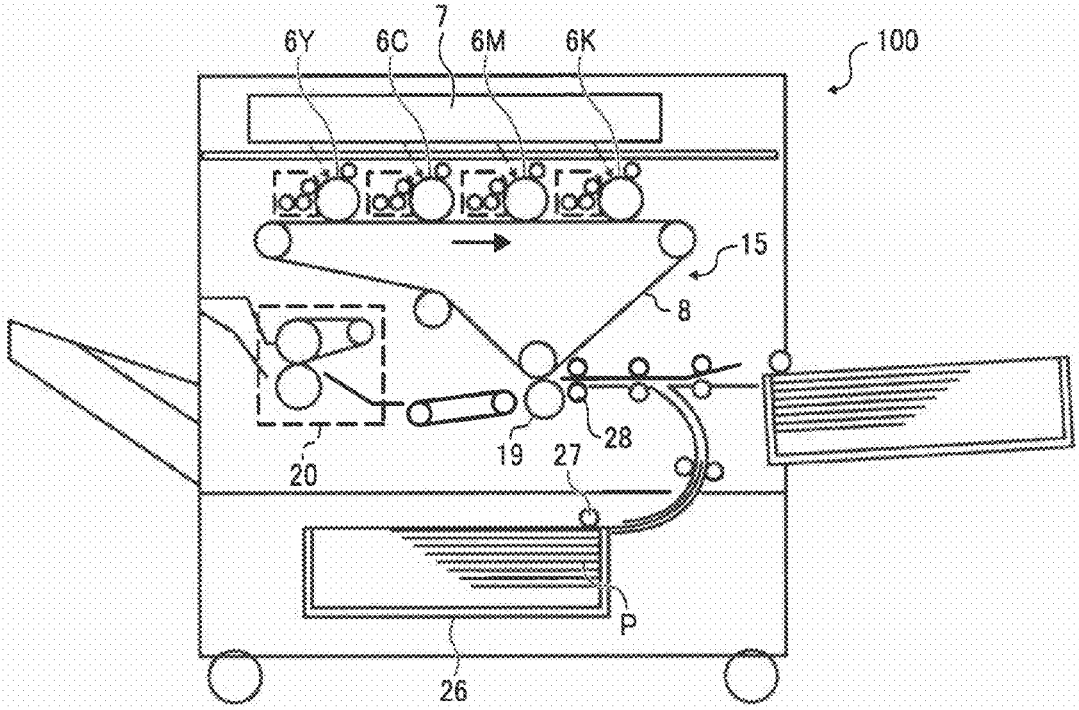
FIG. 1 is a schematic side view of an image forming apparatus according to a first embodiment of the present invention.

Exemplary embodiments of the present invention are explained in detail in the following with reference to the drawings. Corresponding or identical portions in the drawings are given the same numerals, with duplicate explanations being simplified or omitted as appropriate.

In this application, "to the front" is defined as the side to which the belt device is pulled outwards with respect to the image forming apparatus body (side to the front side of the pulling out direction). Further, "to the rear" is the opposite side to "to the front" and is defined as a direction of pulling out the belt device to the back. "Widthwise direction" is defined as a horizontal direction orthogonal to the pulling-out direction.

A first embodiment of the present invention is explained in detail below with reference to FIGS. 1 to 9.

Figure 2:
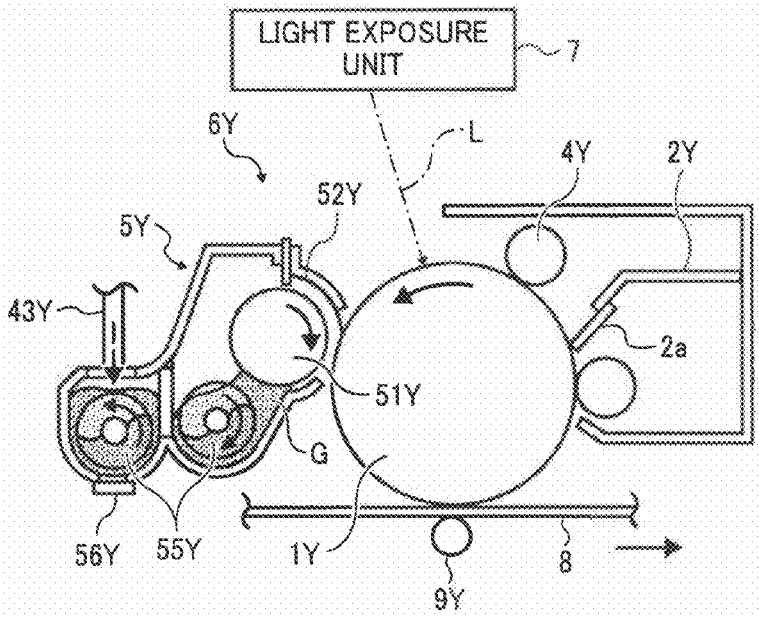
FIG. 2 is a schematic side view of an image-forming unit corresponding to yellow shown in FIG. 1.

First, an overall structure and operation of an image forming apparatus is explained with reference to FIGS. 1 and 2. FIG. 1 is a side view of a printer as an image forming apparatus, and FIG. 2 is schematic view of an image-forming unit corresponding to yellow shown in FIG. 1. As shown in FIG. 1, an intermediate transfer belt device 15 is disposed as a belt device at the center of an image forming apparatus body 100. Operation units 6Y, 6M, 6C, 6K corresponding to yellow, magenta, cyan, black, respectively, are then disposed next to each other facing an intermediate transfer belt 8 (belt member) of the intermediate transfer belt device 15.

As shown in FIG. 2, the operation unit 6Y corresponding to yellow includes a photosensitive drum 1Y as an image carrier, an electrostatic charging unit 4Y disposed at the periphery of the photosensitive drum 1Y, a developing unit 5Y, a cleaning unit 2Y, and a charge removal unit (not shown). A developing process (charging, exposure, developing, transfer, and cleaning) is carried out on the photosensitive drum 1Y. As a result, a yellow image is formed on the photosensitive drum 1Y.

With the exception of the color of the toner used being different, the remaining three operation units 6M, 6C, 6K have substantially the same structure as the operation unit 6Y for yellow and form images corresponding to the respective toner colors. In the following, a description is given only of the operation unit 6Y, with descriptions of the remaining three operation units 6M, 6C, 6K being omitted as appropriate.

Referring to FIG. 2, the photosensitive drum 1Y is rotated in an anti-clockwise direction by a drive motor (not shown). The surface of the photosensitive drum 1Y is uniformly charged at the position of the electrostatic charging unit 4Y (charging). After this, the charged surface of the photosensitive drum 1Y reaches an irradiation position of laser light L emitted from a light exposure unit 7. A latent image corresponding to yellow is then formed by exposure scanning at this position (exposing).

The latent-image formed surface of the photosensitive drum 1Y then reaches a position corresponding to the developing unit 5Y. A latent image is developed at this position and a yellow toner image is formed (developing). The toner-image formed surface of the photosensitive drum 1Y then reaches a position corresponding to the intermediate transfer belt 8 (belt member) and the transfer roller 9Y (primary transfer roller). A toner image on the photosensitive drum 1Y is then transferred onto the intermediate transfer belt 8 at this position (primary transfer). A small amount of un-transferred toner may remain on the photosensitive drum 1Y at this time.

The surface of the photosensitive drum 1Y then reaches a position corresponding to the cleaning unit 2Y. Un-transferred toner remaining on the photosensitive drum 1Y at this position is then recovered to within the cleaning unit 2Y by a cleaning blade 2*a* (cleaning). Finally, the surface of the photosensitive drum 1Y reaches a position corresponding to the charge removal unit (not shown). Residual potential on the photosensitive drum 1Y is then completely removed at this position. This completes a series of development processes carried out on the photosensitive drum 1Y.

The development processes for the operation units 6M, 6C, 6K are the same as for the yellow operation unit 6Y. Laser light L based on image information is irradiated from the light exposure unit 7 disposed above the operation unit towards photosensitive drums 1M, 1C, 1K of each operation unit 6M, 6C, 6K. The light exposure unit 7 emits the laser light L from a light source and irradiates the photosensitive drum with the laser light L via a plurality of optical elements while scanning with the laser light using a rotating polygon mirror. Toner images for each color formed on each photosensitive drum via the developing step are then overlaid and transferred onto the intermediate transfer belt 8 thereby forming a full color image on the intermediate transfer belt 8.

Figure 3:
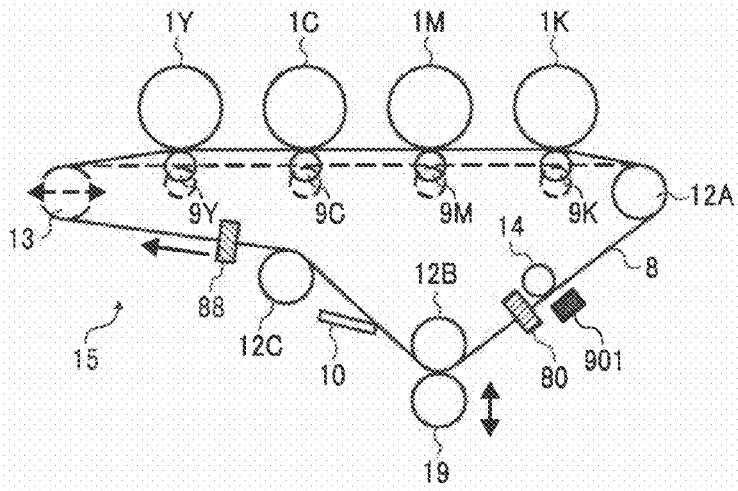
FIG. 3 is a schematic view of a belt device shown in FIG. 1.

As shown in FIG. 3, the intermediate transfer belt device 15 (belt device) includes the intermediate transfer belt 8, four transfer rollers 9Y, 9M, 9C, and 9K, a drive roller 12A, a tension roller 12B, a tension roller 12C, a correction roller 13 (correcting unit), a movable secondary transfer roller 19, a restricting roller 14, a meandering detecting unit 80 (detecting unit), an abnormality detecting unit 88, a photosensor 901, and an intermediate transfer cleaning unit 10. The intermediate transfer belt 8 is an endless belt that spans across in a tensioned manner, is supported by the roller members 12A to 12C, 13, and 14 and is driven by drive force of one roller member, i.e., the drive roller 12A, in the clockwise direction, i.e., the direction of an arrow in FIG. 3.

The four transfer rollers 9Y, 9M, 9C, and 9K (primary transfer rollers) form a primary transfer nip by sandwiching the intermediate transfer belt 8 together with the photosensitive drums 1Y, 1M, 1C, and 1K. A transfer voltage (transfer bias) of a polarity opposite to the toner polarity is then applied to the transfer rollers 9Y, 9M, 9C, and 9K. The intermediate transfer belt 8 then travels in the clockwise direction and sequentially passes through the primary transfer nip of the transfer rollers 9Y, 9M, 9C, and 9K. Toner images for each of the colors on the photosensitive drums 1Y, 1M, 1C, and 1K then undergo primary transfer so as to be overlaid on the intermediate transfer belt 8.

After this, the toner images on the intermediate transfer belt 8 reach a position facing the secondary transfer roller 19. At this position, the tension roller 12B sandwiches the intermediate transfer belt 8 together with the secondary transfer roller 19 so as to form a secondary transfer nip. A transfer voltage (secondary transfer bias) of a polarity opposite to the toner polarity is then applied to the secondary transfer roller 19. As a result, the toner images on the intermediate transfer belt 8 are transferred onto a recording medium P such as transfer paper conveyed to the position of the secondary transfer nip. At this time, un-transferred toner that was not transferred to the recording medium P may remain on the intermediate transfer belt 8.

After this, the intermediate transfer belt 8 reaches the position of the intermediate transfer cleaning unit 10. Un-transferred toner on the intermediate transfer belt 8 is then removed at this position. This completes the series of transfer processes taking place on the intermediate transfer belt 8. The structure and operation of the intermediate transfer belt device 15 taken as a belt device are now explained in detail using FIGS. 3 to 9.

Referring to FIG. 1, a paper feeding unit 26 is disposed at the bottom of the image forming apparatus body 100. Paper feeding rollers 27 and registration rollers 28 pick-up one blank recording medium P from the paper feeding unit 26 and convey it to the position of the secondary transfer nip. An additional paper feeding unit can be disposed at a side of the image forming apparatus body 100. Specifically, a plurality of recording media P such as paper sheets are housed one on top of another at the paper feeding unit 26. When the paper feeding rollers 27 are rotated in an anti-clockwise direction, an uppermost recording medium P is fed in a direction to between the registration rollers 28.

The recording medium P conveyed to the registration rollers 28 is then temporarily stopped at the position of a roller nip of the registration rollers 28 for which rotation has stopped. The registration rollers 28 are then rotated in line with the timing of a color image on the intermediate transfer belt 8 and the recording medium P is conveyed in the direction of the secondary transfer nip. An image of the desired color is therefore transferred onto the recording medium P.

After this, the recording medium P to which the color image is transferred to at the position of the secondary transfer nip is conveyed to the position of a fixing unit 20. In the fixing unit 20, the color image transferred to the surface is fixed onto the recording medium P using heat and pressure of a fixing roller and a pressure roller. The recording medium P is then discharged to outside of the device by a pair of paper ejection rollers (not shown). The recording media P subjected to transfer is discharged to outside of the device by the paper ejection rollers is then sequentially stacked on a stack unit as output images. The series of image-forming processes occurring at the image forming apparatus body 100 are then complete.

Next, a detailed description is given of the structure and operation of the developing unit 5Y. The developing unit 5Y includes a developing roller 51Y facing the photosensitive drum 1Y, a doctor blade 52Y facing the developing roller 51Y, two conveyor screws 55Y disposed within a developer container, a toner supply path 43Y communicating via an opening at the developer container, and a density detection sensor 56 that detects toner density within the developer. The developing roller 51Y includes a magnet installed inside and a sleeve rotating the periphery of the magnet. A two-component developer composed of a carrier and a toner is housed within the developer container.

The developing unit 5Y operates as follows. The sleeve of the developing roller 51Y rotates in the direction of the arrow of FIG. 2. Developer supported on the developing roller 51Y, due to the magnetic field generated by the magnet installed inside and the sleeve, moves on the developing roller 51Y in accompaniment with rotation of the sleeve. Developer within the developing unit 5Y is adjusted so that a proportion of toner within the developer, i.e., the toner density, is within a predetermined range. The toner supplied to within the developer container is then circulated in two isolated developer containers while being mixed and agitated together with the developer by the two conveyor screws 55Y (movement in a direction perpendicular to the paper in FIG. 2). The toner in the developer is then absorbed by the carrier as a result of frictional electrification with the carrier and is supported on the developing roller 51Y together with the carrier due to magnetic force present at the developing roller 51Y.

The developer supported on the developing roller 51Y is conveyed in the direction of the arrow of FIG. 2 and reaches the position of the doctor blade 52Y. The developer on the developing roller 51Y is then conveyed as far as a position (developing region) facing the photosensitive drum 1Y after the amount of developer is optimized at this position. The toner is then absorbed at the latent image formed on the photosensitive drum 1Y by the electric field formed at the developing region. The developer remaining on the developing roller 51Y then reaches the upper part of the developer container in accompaniment with rotation of the sleeve and the developing roller 51Y is then separated at this position.

Figure 4:
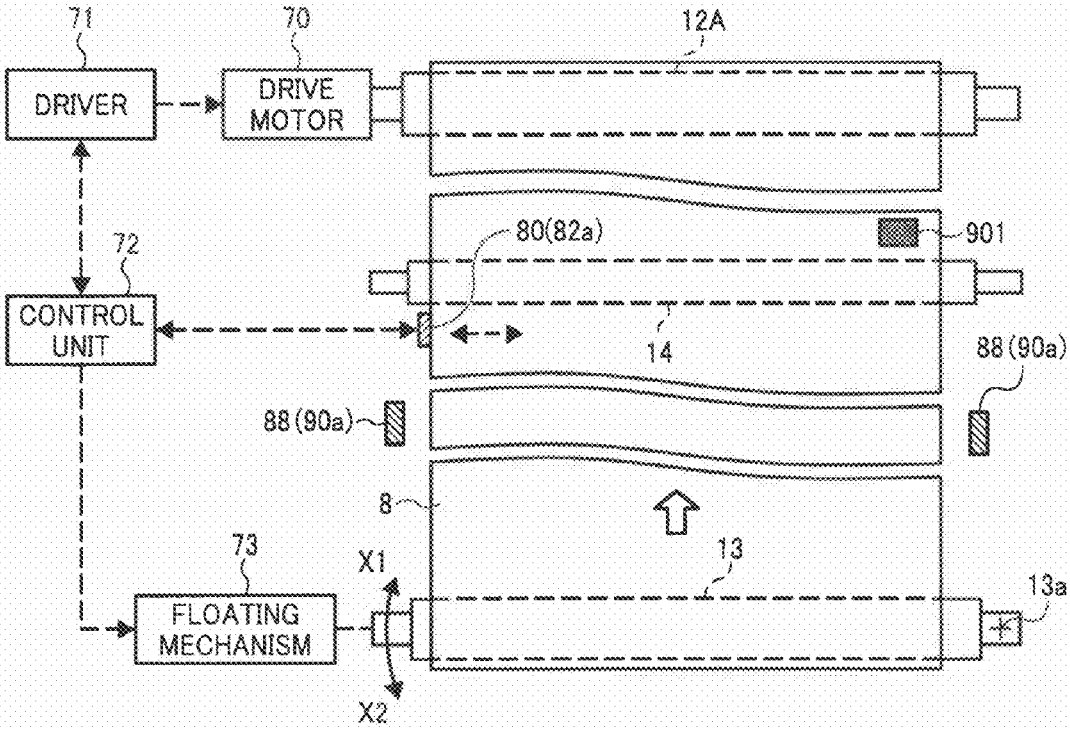
FIG. 4 is a schematic plane view of a part of the belt device shown in FIG. 3.
Figure 5:
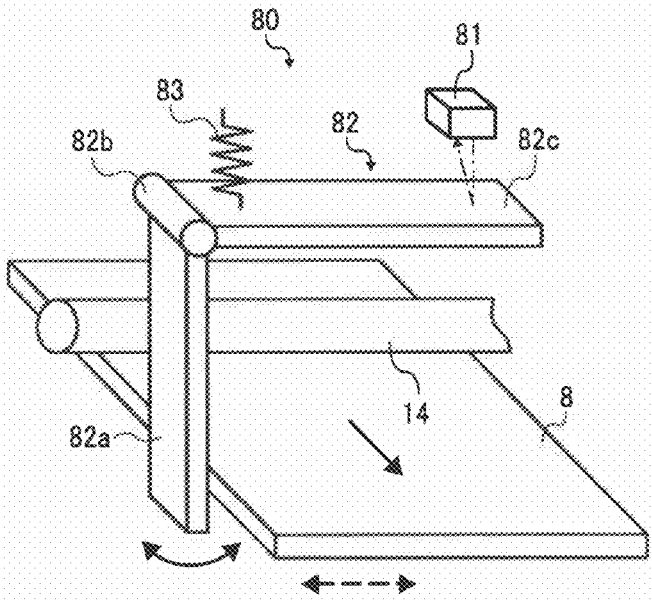
FIG. 5 is a perspective view of a meandering detecting unit shown in FIG. 4.
Figure 6:
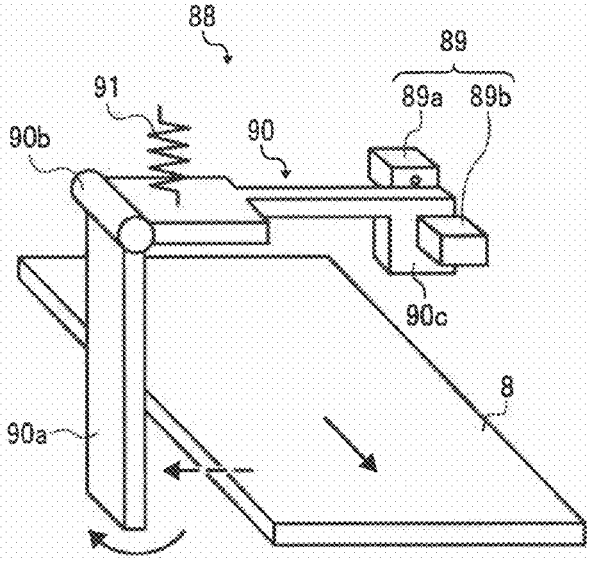
FIG. 6 is a perspective view of an abnormality detecting unit shown in FIG. 4.

Next, the intermediate transfer belt device 15 (belt device) of this embodiment is explained referring to FIGS. 3 to 9. FIG. 3 is a schematic diagram showing the intermediate transfer belt device 15. FIG. 4 is a schematic plane view of a part of the intermediate transfer belt device 15. FIG. 5 is a perspective view showing the vicinity of the meandering detecting unit 80 shown in FIG. 4. FIG. 6 is a perspective view showing the vicinity of the abnormality detecting unit 88 shown in FIG. 4.

Referring to FIGS. 3 and 4, the intermediate transfer belt device 15 includes the intermediate transfer belt 8 that is the belt member, the four transfer rollers 9Y, 9M, 9C, and 9K, the drive roller 12A, the tension roller 12B and the tension roller 12C, the correction roller 13 as a correcting unit, the restricting roller 14, the meandering detecting unit 80 as a detecting unit, an abnormality detecting unit 88, the photosensor 901, and the intermediate transfer cleaning unit 10.

The intermediate transfer belt 8 taken as a belt member is disposed facing the photosensitive drums 1Y, 1M, 1C, and 1K taken as four image carriers supporting toner images for each color. The intermediate transfer belt 8 is supported in a tensioned manner mainly on five roller members, i.e., the drive roller 12A, the tension roller 12B, the tension roller 12C, the correction roller 13, and the restricting roller 14.

The intermediate transfer belt 8 can be formed from one or a plurality of layers of PVDF (polyvinylidene fluoride), ETFE (ethylene tetrafluoroethylene), PI (polyamide), or PC (polycarbonate) etc. dispersed in a conductive material such as carbon black. The intermediate transfer belt 8 is adjusted to have a volume resistivity of $10^7$ ohm/cm to $10^{12}$ ohm/cm, and the surface resistivity of the rear surface side of the belt is adjusted to the range of $10^8$ ohm/cm to $10^{12}$ ohm/cm. The intermediate transfer belt 8 can have a thickness in the range of 80 micrometers to 100 micrometers. In this embodiment, a 90-micrometer thick and 2197.5-millimeter long intermediate transfer belt 8 was used. The surface of the intermediate transfer belt 8 can be coated with a separating layer as necessary. During this time, a fluororesin such as ETFE (ethylene tetrafluoroethylene), PTFE (polytetrafluoroethylene), PVDF (polyvinylidene fluoride), PEA (perfluoroalkoxy), FEP (fluorinated ethyl propylene copolymer), or PVF (polyvinyl fluoride) is used but this is not limiting. The method for manufacturing the intermediate transfer belt 8 can be an injection method or a centrifugal forming method etc. with the surface being polished as necessary.

The transfer rollers 9Y, 9M, 9C, and 9K face the corresponding photosensitive drums 1Y, 1M, 1C, and 1K with the intermediate transfer belt 8 therebetween. Specifically, the yellow transfer roller 9Y faces the yellow photosensitive drum 1Y with the intermediate transfer belt 8 therebetween, the magenta transfer roller 9M faces the magenta photosensitive drum 1M with the intermediate transfer belt 8 therebetween, the cyan transfer roller 9C faces the cyan photosensitive drum 1C with the intermediate transfer belt 8 therebetween, and the black transfer roller 9K faces the photosensitive drum 1C with the intermediate transfer belt 8 therebetween.

The four transfer rollers 9Y, 9M, 9C, and 9K are configured so that they can separate the intermediate transfer belt 8 from the photosensitive drums 1Y, 1M, 1C, and 1K. Specifically, the three transfer rollers 9Y, 9M, and 9C for color use out of the four transfer rollers 9Y, 9M, 9C, and 9K are integrally supported at a holding member (not shown) and are capable of being moved integrally in a vertical direction. The black transfer roller 9K can also be independently moved vertically. The intermediate transfer belt 8 can be separated from the photosensitive drums 1Y, 1M, 1C, and 1K (moved to the position of the dashed line) by moving the four transfer rollers 9Y, 9M, 9C, and 9K to the position of the dashed line in FIG. 3. The operation of separating the intermediate transfer belt 8 from the photosensitive drums 1Y, 1M, 1C, and 1K is performed in order to reduce wear on the intermediate transfer belt 8 and is therefore mainly performed when image-forming is not taking place. The structure is which the black transfer roller 9K can be moved independent of the transfer rollers 9Y, 9M, 9C for color use is adapted so that the black transfer roller 9K can be moved and separated from the intermediate transfer belt 8 when not forming a black image.

The drive roller 12A is rotated by a drive motor 70. This causes the intermediate transfer belt 8 to advance a predetermined extent in the direction of travel (clockwise direction of FIG. 3). The drive motor 70 is a stepping motor operated by a drive signal (pulse signal) from a driver 71 controlled by a control unit 72. The tension roller 12B abuts with the secondary transfer roller 19 via the intermediate transfer belt 8. The other tension roller 12C abuts with the outer peripheral surface of the intermediate transfer belt 8. The intermediate transfer cleaning unit 10 (cleaning blade) is disposed between the tension rollers 12B and 12C.

The meandering detecting unit 80 detects displacement of the intermediate transfer belt 8 in a widthwise direction (direction perpendicular to the paper of FIG. 3). Referring to FIG. 5, the meandering detecting unit 80 includes an L-shaped reciprocating member 82 abutting with the side of the intermediate transfer belt 8, a distance sensor 81 that detects the extent of displacement of the reciprocating member 82, and a spring 83 that urges the reciprocating member 82 in a direction of abutment with the intermediate transfer belt 8.

The reciprocating member 82 includes a first arm section 82*a*, a rotating support shaft 82*b*, and a second arm section 82*c*. An end of the first arm section 82*a* abuts with the side of the intermediate transfer belt 8 and the other end is fixed to the rotating support shaft 82*b*. The rotating support shaft 82*b* is supported in a freely rotating manner at a casing (not shown) of the intermediate transfer belt device 15. An end of the second arm section 82*c* is fixed to the rotating support shaft 82*b*. An end of the spring 83 is connected to the center of the second arm section 82*c*. The other end of the spring 83 is connected to the casing. The reciprocating member 82 reciprocates (reciprocation in the direction of the double-headed arrow in FIG. 5) in accordance with displacement of the intermediate transfer belt 8 in the direction of the dashed line double-headed arrow in FIG. 5 as the intermediate transfer belt 8 travels in the direction of the single-headed arrow in FIG. 5. In the first embodiment, the intermediate transfer belt 8 is set to travel at a speed of 439.93 mm/s in normal time in the direction of travel (direction of an arrow in FIG. 5).

The distance sensor 81 is installed at the upper part of the other end of the second arm section 82*c*. The distance sensor 81 mainly includes light-emitting elements (infra-red light-emitting diodes) disposed next to each other spaced across the horizontal direction and a position sensing detector (PSD). Infra-red light emitted from the light-emitting elements is reflected by the surface of the second arm section 82*c* so as to be incident to the position detecting elements as reflected light. A position of incidence of the reflected light incident to the position detecting elements changes with a change in the distance between the distance sensor 81 and the second arm section 82*c*. An output value of the distance sensor 81 then changes in proportion to this. It is therefore possible to detect an extent of displacement, i.e., the distance to the surface of the second arm section 82*c*, of the intermediate transfer belt 8 in a widthwise direction. When a distance detected by the distance sensor 81 is larger than a predetermined value, i.e., when the output value (voltage) of the distance sensor 81 is larger than a predetermined value, it means that the intermediate transfer belt 8 is displaced in the plus direction (position shift to the left side of FIG. 5) with regards to a target position. On the contrary, when the distance detected by the distance sensor 81 is smaller than a predetermined value, i.e., when the output value (voltage) of the distance sensor 81 is smaller than a predetermined value, it means that the intermediate transfer belt 8 is displaced in the minus direction (position shift to the right side of FIG. 5) with respect to the target position.

In the first embodiment, the meandering detecting unit 80 detects (abnormal detection) abnormal belt bias during normal image-forming (during printing) etc. Belt position shift correction is then performed by the correction roller 13 based on the detection results of the meandering detecting unit 80 taking a belt bias (position shift) of plus or minus 0.5 millimeters (mm) with respect to a reference position (i.e., when the position shift is 0 mm) as a permitted range (permitted print range). When the belt bias (position shift) of the intermediate transfer belt 8 goes outside a detection range (plus or minus 1 mm) of the meandering detecting unit 80, it means that a comparatively large belt bias has occurred. In that case the device is therefore forcibly stopped and an abnormality detection is displayed at a display unit (not shown) of the image forming apparatus body 100. Abnormality detection is also performed by an abnormality detecting unit 88 in addition to the abnormality detection performed by the meandering detecting unit 80. This duplication of the detection of abnormalities for belt bias is carried out so that abnormality detection is reliably carried out even if the meandering detecting unit 80 is damaged or runaway of the control software occurs.

The restricting roller 14 restricts the displacement of the intermediate transfer belt 8 in a direction perpendicular to the surface of the intermediate transfer belt 8. The restricting roller 14 is disposed near to the meandering detecting unit 80. Specifically, the restricting roller 14 is near and on an upstream side in the direction of travel of the intermediate transfer belt 8 with respect to the abutting position of the first arm section 82*a* and the intermediate transfer belt 8. With the above structure, displacement (runout) of the intermediate transfer belt 8 in a direction perpendicular to surface of the intermediate transfer belt 8 near the meandering detecting unit 80 is alleviated. Namely, because the restricting roller 14 restricts displacement of the intermediate transfer belt 8 by applying tension to the intermediate transfer belt 8, displacement of the reciprocating member 82 in a direction perpendicular to the surface of the intermediate transfer belt 8 is also restricted. As a result, the inconvenience of detecting a displacement component for different directions to the widthwise direction and the direction of travel can be reduced. Namely, the detection precision can be improved.

If the meandering detecting unit 80 detects displacement of the intermediate transfer belt 8, the correction roller 13 (meandering correction mechanism) is used to correct the displacement. Referring to FIG. 3, the correction roller 13 is disposed upstream in a direction of travel of the intermediate transfer belt 8 with respect to the photosensitive drums 1Y, 1M, 1C, and 1K and makes contact with the inner surface of the intermediate transfer belt 8. Referring to FIGS. 4 and 6, the correction roller 13 reciprocates in directions X1 and X2 (up and down) taking a center of reciprocation 13*a* as center as a result of the drive cam (not shown) of a floating mechanism 73 shifting at predetermined angle. When the intermediate transfer belt 8 is displaced to the right side (as viewed from the belt) in FIG. 4, the correction roller 13 is caused to reciprocate in the X2 direction by the floating mechanism 73 so as to correct displacement of the intermediate transfer belt 8. On the contrary, when the intermediate transfer belt 8 is displaced to the left side in FIG. 4, the correction roller 13 is caused to reciprocate in the direction X1 by the floating mechanism 73 so as to carry out displacement correction of the intermediate transfer belt 8. This makes it possible to prevent the intermediate transfer belt 8 from meandering or the intermediate transfer belt 8 from becoming damaged as a result of being displaced substantially in a widthwise direction (towards the belt) so as to come into contact with other members.

Referring to FIG. 4, in the intermediate transfer belt device 15, the abnormality detecting unit 88 is disposed at a position spaced a prescribed distance from the ends of the intermediate transfer belt 8 in a widthwise direction. The abnormality detecting unit 88 includes an arm member 90 making contact with a side of the intermediate transfer belt 8 when there is substantial belt bias, an over-run detection sensor 89 (optical sensor) that optically detects movement taking a rotating spindle 90*b* of the arm member 90 as center using contact of the intermediate transfer belt 8, and a spring 91 for maintaining the posture of the arm member 90.

The arm member 90 includes a first arm section 90*a*, the rotating spindle 90*b*, and a second arm section 90*c*. One end of the first arm section 90*a* is set at a position 5 millimeters from the side of the intermediate transfer belt 8 that is in a normal position and the other end is fixed to at the rotating spindle 90*b*. The rotating spindle 90*b* is supported in a freely rotating manner at a casing (not shown) of the intermediate transfer belt device 15. An end of the second arm section 90*c* is fixed to the rotating spindle 90*b*, and the other end is set between a light-emitting unit 89*a* and a light-receiving unit 89*b* of the over-run detection sensor 89. An end of the spring 91 is connected to the center of the second arm section 90*c*. The other end of the spring 91 is connected to the casing. One end of the second arm section 90*c* abuts with a positioning section of the casing as a result of the urging force of the spring 91.

When a substantial belt bias exceeding 5 mm occurs at the intermediate transfer belt 8, the arm member 90 abuts with the intermediate transfer belt 8 and reciprocates (reciprocates in the direction of a solid line arrow in FIG. 6). This situation is then detected by the over-run detection sensor 89. This is to say that separating of an end of the second arm section 90*c* from between the light-emitting unit 89*a* and the light-receiving unit 89*b* is then recognized as a result of light emitted from the light-emitting unit 89*a* being received by the light-receiving unit 89*b*. When an abnormality is then detected by the abnormality detecting unit 88 (over-run detection sensor 89), driving of the intermediate transfer belt 8 (the drive roller 12A) is stopped. The driving of the photosensitive drums 1Y, 1M, 1C, and 1K and the driving of the secondary transfer roller 19 is also stopped. The operation of relatively separating the intermediate transfer belt 8 from the photosensitive drums 1Y, 1M, 1C, and 1K and from the secondary transfer roller 19 is then forcibly carried out. An instruction to call a member of the service staff is then displayed at a display unit of the image forming apparatus body 100 (display to the effect that it is necessary for a member of the service staff to carry out repairs). In the first embodiment, referring to FIG. 3, the secondary transfer roller 19 is able to move freely into contact with and away from the intermediate transfer belt 8 (move in the direction of the arrow).

Referring to FIGS. 3 and 4, the intermediate transfer belt device 15 is provided with the photosensor 901. The photosensor 901 detects the position and density of the toner images (batch pattern) supported at the intermediate transfer belt 8 and optimizes the image-producing conditions. Specifically, shifts in positions of toner images (batch patterns) for each color formed on the intermediate transfer belt 8 via the image-forming processes are optically detected by the photosensor 901. The timing of the exposure of each of the photosensitive drums 1Y, 1M, 1C, and 1K by the light exposure unit 7 is then adjusted based on the detection results. The density (toner density) of toner images (batch patterns) formed on the intermediate transfer belt 8 via the image-forming processes is optically detected by the photosensor 901. The toner density of the developer housed in the developing unit 5Y (and developing units 5C, 5M, and 5K) is then adjusted based on the detection results.

Figure 7:
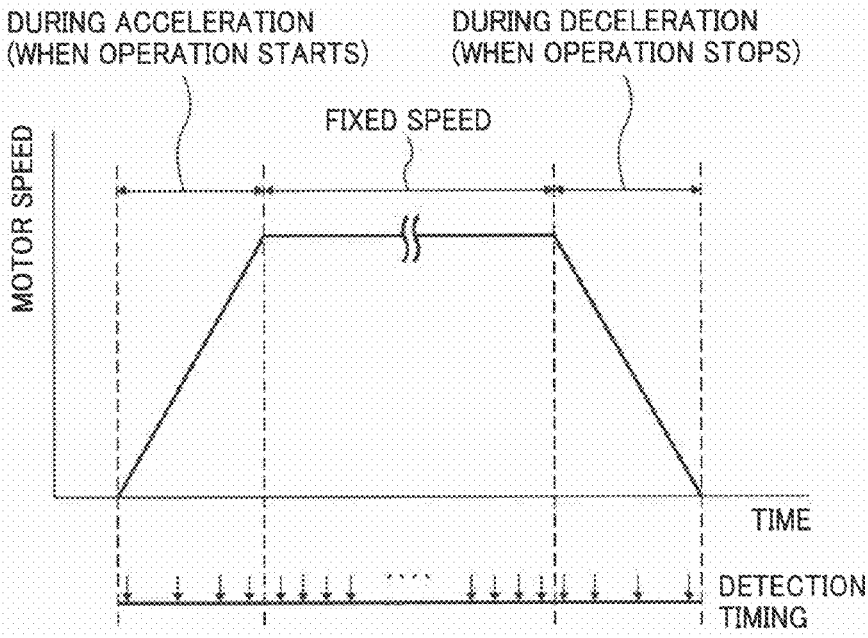
FIG. 7 is a graph showing speed fluctuation of a drive motor.
Figure 8:
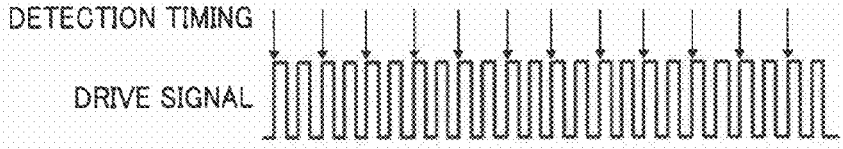
FIG. 8 is a timing chart showing a relationship between a drive signal and detection timing.
Figure 9:
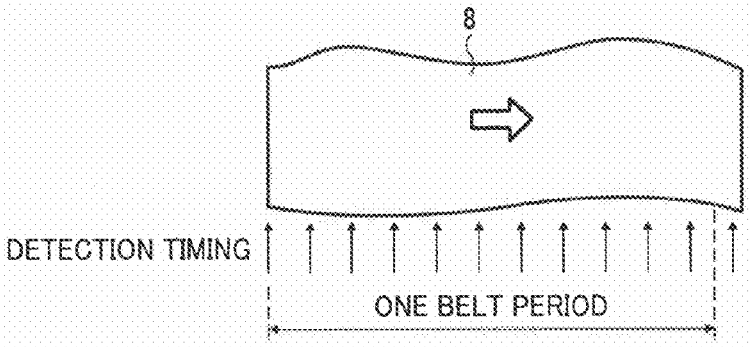
FIG. 9 is a partially exploded plane view showing an end of an intermediate transfer belt shown in FIG. 4.

An explanation is now given using FIGS. 7 to 9 of characteristic control performed at the intermediate transfer belt device 15. FIG. 7 is a graph showing fluctuations in speed of the drive motor 70 driving the intermediate transfer belt 8 (drive roller 12A). As shown in FIG. 7, in the first embodiment, when operation of the intermediate transfer belt device 15 starts, the speed of travel of the intermediate transfer belt 8 gradually accelerates (slow starting). After a prescribed time, the intermediate transfer belt 8 then travels at normal speed (fixed speed). When operation of the intermediate transfer belt device 15 then stops, the speed of travel of the intermediate transfer belt 8 then gradually decelerates (slowing down) and the operation of the intermediate transfer belt device 15 stops. It is then possible to suppress the application of abrupt loads to configuration components constituting the intermediate transfer belt device 15 by controlling acceleration and deceleration of the intermediate transfer belt 8 to match with the stopping and starting of operation of the intermediate transfer belt device 15.

Referring to FIG. 8, in the first embodiment, control is exerted so as to correct the displacement (meandering) of the intermediate transfer belt 8 in the widthwise direction using the correction roller 13 (correcting unit) based on data sampled by the meandering detecting unit 80 (detecting unit) each time a drive signal is input to the drive motor 70 a prescribed number of times (for example, every 676 times. The case of three times is described in FIG. 8). Sampling is therefore carried out by the meandering detecting unit 80 every time the number of drive signals input to the drive motor 70 reaches a prescribed number. A plurality of items of sampled data (detection results) are then averaged. Meandering correction is then carried out by the correction roller 13 taking this averaged value as a value to be corrected.

The correction roller 13 can therefore correct meandering of the intermediate transfer belt 8 based on data sampled by the meandering detecting unit 80 every time the intermediate transfer belt 8 travels a prescribed distance regardless of whether acceleration and deceleration of the intermediate transfer belt 8 is being controlled. The plurality of items of data sampled by the meandering detecting unit 80 are also evenly spaced with respect to the direction of travel of the intermediate transfer belt 8 even if acceleration and deceleration of the intermediate transfer belt 8 is controlled. Referring to FIG. 9, it is also possible to accurately correct an amount of displacement of the intermediate transfer belt 8 in the widthwise direction without influencing cutting tolerance even when cutting tolerance occurs at the ends of the intermediate transfer belt 8 regardless of the presence of control of acceleration or deceleration of the intermediate transfer belt 8. When control is carried out in this manner, looking at a time axis (horizontal axis) of the graph in FIG. 7, detection timing is long in a region where speed of the motor is low, and the detection timing is short in the region where the speed of the motor is high.

In the first embodiment, sampling is carried out at the meandering detecting unit 80 at equal intervals every 35.2 millimeters with respect to the direction of travel of the intermediate transfer belt 8.

The control (control where the meandering detecting unit 80 samples every time a prescribed number of drive signals are input to the drive motor 70) can also be carried out only when control of acceleration or deceleration of the intermediate transfer belt 8 is carried out. In this event, sampling by the meandering detecting unit 80 can be carried out periodically when the intermediate transfer belt 8 is operating at a fixed speed.

In the first embodiment, control takes place so that a state where correction by the correction roller 13 (correction unit) takes place when operation of the intermediate transfer belt device 15 is stopped is maintained, with the intermediate transfer belt 8 then operating again from this state. When operation of the intermediate transfer belt device 15 stops, the meandering correction state carried out immediately before is continued. For example, if meandering correction is being carried out with the correction roller 13 tilted three degrees in a direction X1 of FIG. 4, operation of the correction roller 13 is stopped with the correction roller 13 remaining tilted three degrees in the direction X1 without returning the correction roller 13 to the home position (a position where the tilt angle is plus or minus zero degrees). When operation of the correction roller then starts again, control of meandering correction starts from a state where the correction roller 13 is tilted by three degrees to the direction X1. It is therefore also possible to reduce meandering of the intermediate transfer belt 8 when operation of the correction roller 135 commences. Namely, when the correction roller 13 starts to operate again and control is carried out to return the correction roller 13 to the home position, tension of the intermediate transfer belt 8 fluctuates and it is easy for meandering of the intermediate transfer belt 8 to occur directly after operation recommences. It is therefore possible to make the time taken for meandering of the intermediate transfer belt 8 to settle short by maintaining the state of correction of meandering when the correction roller 13 stops operation and then restarting operation from this state.

In the first embodiment, data is sampled by the meandering detecting unit 80 (detecting unit) every time the intermediate transfer belt 8 travels a prescribed distance even when the speed of travel of the intermediate transfer belt 8 (belt member) accelerates or decelerates. Displacement in the widthwise direction of the intermediate transfer belt 8 is then corrected based on this data. It is therefore possible for the amount of displacement in the widthwise direction of the intermediate transfer belt 8 to be accurately detected by the meandering detecting unit 80 without influencing the cutting tolerance for both ends in a widthwise direction of the intermediate transfer belt 8 and it is possible to correct meandering of the intermediate transfer belt 8 in a highly precise manner.

Second Embodiment

Figure 10:
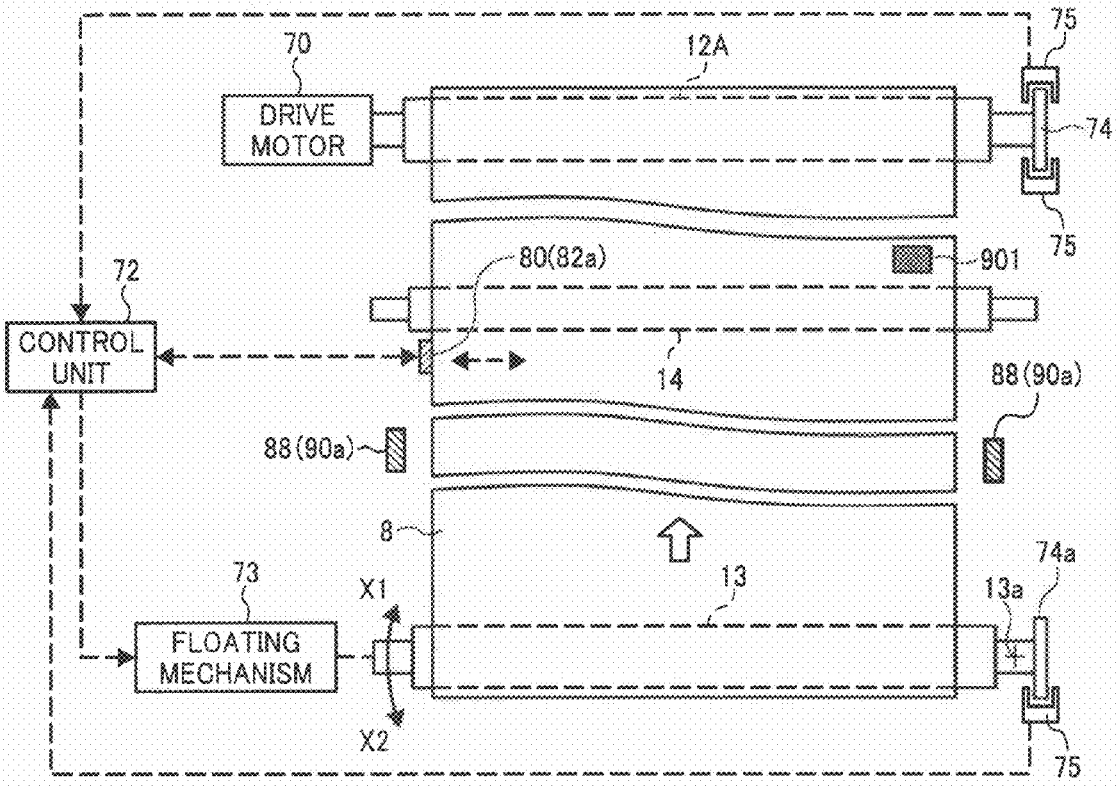
FIG. 10 is a schematic plane view of a part of a belt device according to a second embodiment of the present invention.
Figure 11:
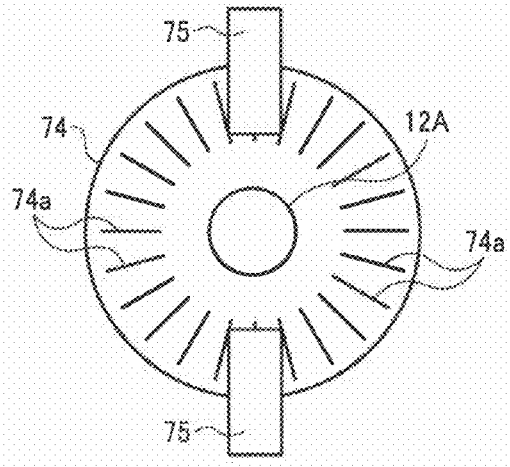
FIG. 11 is a side view of a detecting unit shown in FIG. 10.

A detailed explanation of a second embodiment of the present invention is now given using FIGS. 10 and 11. FIG. 10 is a schematic plane view of a part of an intermediate transfer belt device of a second embodiment. FIG. 10 corresponds to FIG. 4 of the first embodiment. The point for the intermediate transfer belt device of the second embodiment where the meandering detecting unit 80 performs sampling every time the number of times a signal output from a position sensors 75 reaches a prescribed number corresponds to that where in the first embodiment the meandering detecting unit 80 samples every time the number of drive signals input to the drive motor 70 reaches a prescribed number.

As shown in FIG. 10, two position sensors 75 are provided at the intermediate transfer belt device of the second embodiment as a second detecting unit for detecting an extent of rotation of the drive roller 12A. Referring to FIGS. 10 and 11, a detection-target plate 74 formed with radial slits 74*a* is disposed at a shaft of the drive roller 12A. Two position sensors 75 are then fixed at two locations on a casing of the intermediate transfer belt device 15 so as to sandwich the detection-target plate 74. The position sensors 75 are optical sensors composed of a light-emitting element and a light-receiving element. Light emitted from the light-receiving element passes through the slits 74*a*. A position in a rotating direction of the detection-target plate 74 is then detected from a number of times (the number of times output fluctuates) the light reaches the light-receiving element. The amount of rotation of the drive roller 12A rotating integrally together with the detection-target plate 74 can then be detected.

Control is then exerted so as to correct displacement in a widthwise direction of the intermediate transfer belt 8 using the correction roller 13 based on data sampled by the meandering detecting unit 80 every time a signal output by the position sensors 75 (second detecting unit) reaches a prescribed number of times. Sampling is therefore carried out by the meandering detecting unit 80 every time the signals output by the position sensors 75 reaches a prescribed number. A plurality of items of sampled data (detection results) are then averaged. Meandering correction is then carried out by the correction roller 13 taking this averaged value as a value to be corrected.

The correction roller 13 can therefore correct meandering of the intermediate transfer belt 8 based on data sampled by the meandering detecting unit 80 every time the intermediate transfer belt 8 travels a prescribed distance regardless of whether acceleration and deceleration of the intermediate transfer belt 8 is being controlled. The plurality of items of data sampled by the meandering detecting unit 80 are also evenly spaced with respect to the direction of travel of the intermediate transfer belt 8 even if acceleration and deceleration of the intermediate transfer belt 8 is controlled. It is therefore possible to accurately detect an amount of displacement in a widthwise direction of the intermediate transfer belt 8 without influencing the cutting tolerance even when cutting tolerance occurs at both ends of the intermediate transfer belt 8 regardless of the presence of acceleration or deceleration control of the intermediate transfer belt 8.

As shown in FIG. 10, the roller member installed with the second detecting unit is not limited to being the drive roller 12A but can be other roller member such as the correction roller 13. Moreover, the number of the position sensors 75 is not limited to being two, it can be one.

In the second embodiment, as in the first embodiment, data is sampled by the meandering detecting unit 80 (detecting unit) every time the intermediate transfer belt 8 travels a prescribed distance even when the speed of travel of the intermediate transfer belt 8 (belt member) accelerates or decelerates. Displacement of the intermediate transfer belt 8 in a widthwise direction is then corrected based on this data. It is then possible to accurately detect the amount of displacement of the intermediate transfer belt 8 in a widthwise direction using the meandering detecting unit 80 without influencing the cutting tolerance for both ends of the intermediate transfer belt 8 in a widthwise direction and meandering of the intermediate transfer belt 8 can be corrected in a highly precise manner.

In the above-explained embodiments, the present invention is applied to the intermediate transfer belt 8. However, the present invention is also applicable to a transfer belt. The present invention is also applicable to a photosensitive belt.

The present invention is not limited to the above-explained embodiments and it is clear that appropriate modifications of the embodiments are possible other than suggested here while remaining within the scope of the technical concept of the present invention. The number, position, and shape etc. of the members of the configuration are not limited to these embodiments and a preferred number, position, and shape etc. can be adopted in implementing the present invention.

The present invention therefore provides a belt device and an image forming apparatus where data is sampled by a detecting unit every time a belt member travels a prescribed distance. In order to then correct displacement in a widthwise direction of the belt member based on this data even when the speed the belt member is traveling at accelerates or decelerates, an amount of displacement of the belt member in the widthwise direction is accurately detected by the detecting unit without influencing the cutting tolerance for both ends of the belt member in a widthwise direction. Correction of meandering of the belt member can then be carried out precisely.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device for use in an image forming apparatus, the belt device comprising:

an endless belt that is suspended in a tensioned manner by a plurality of rollers including a drive roller;

a drive motor that drives the drive roller so as to move the belt in a predetermined direction of travel;

a first detecting unit that detects an amount of displacement of the belt between a first set of the rollers in a widthwise direction of the belt;

a second detecting unit which detects a displacement of the belt in the widthwise direction between a second set of the rollers which is different from the first set of the rollers and outputs a signal indicating to stop a movement of the belt, when the displacement of the belt in the widthwise direction is detected by the second detecting unit to be abnormal;

a display which displays a message for a service call, when the second detecting unit detects the displacement of the belt in the widthwise direction is abnormal; and a correction unit that corrects displacement of the belt in the widthwise direction based on data from the first detecting unit without using data from the second detecting unit.

2. The belt device according to claim 1, wherein the correction unit corrects displacement of the belt in the widthwise direction when the belt is accelerating or decelerating.

3. The belt device according to claim 1, wherein a state of correction by the correction unit is maintained when the belt device stops operation, and operation of the belt device starts again from this state.

4. An image forming apparatus comprising the belt device disclosed in claim 1.

5. A belt device for use in an image forming apparatus, the belt device comprising:

an endless belt that is suspended in a tensioned manner by a plurality of rollers including a detection target roller;

a first detecting unit that detects an amount of displacement of the belt between a first set of the rollers in a widthwise direction of the belt;

a second detecting unit which detects a displacement of the belt in the widthwise direction between a second set of the rollers which is different from the first set of the rollers and outputs a signal indicating to stop a movement of the belt, when the displacement of the belt in the widthwise direction is detected by the second detecting unit to be abnormal;

a display which displays a message for a service call, when the second detecting unit detects the displacement of the belt in the widthwise direction is abnormal;

a correction unit that corrects displacement of the belt in the widthwise direction; and a rotation detecting unit that detects an amount of rotation of the detection target roller, wherein the correction unit corrects displacement of the belt in the widthwise direction based on data from the first detecting unit every time a number of signals output from the rotation detecting unit reaches a prescribed number without using data from the second detecting unit.

6. The belt device according to claim 5, wherein a state of correction by the correction unit is maintained when the belt device stops operation, and operation of the belt device starts again from this state.

7. An image forming apparatus comprising the belt device disclosed in claim 5.

8. A belt device for use in an image forming apparatus, the belt device comprising:

an endless belt capable of moving in a predetermined direction of travel;

a first detecting unit that detects an amount of displacement of the belt between a first set of rollers in a widthwise direction of the belt;

a second detecting unit which detects a displacement of the belt in the widthwise direction between a second set of rollers which is different from the first set of rollers and outputs a signal indicating to stop a movement of the belt, when the displacement of the belt in the widthwise direction is detected by the second detecting unit to be abnormal;

a display which displays a message for a service call, when the second detecting unit detects the displacement of the belt in the widthwise direction is abnormal; and a correction unit that corrects displacement of the belt in the widthwise direction based on data sampled by the first detecting unit every time the belt member travels a prescribed distance without using data from the second detecting unit.

9. The belt device according to claim 8, wherein a state of correction by the correction unit is maintained when the belt device stops operation, and operation of the belt device starts again from this state.

10. An image forming apparatus comprising the belt device disclosed in claim 8.

* * * * *